US011986100B2

(12) United States Patent
Conn

(10) Patent No.: US 11,986,100 B2
(45) Date of Patent: May 21, 2024

(54) FOLDING CHAIR

(71) Applicant: Westfield Outdoor, Inc., Indianapolis, IN (US)

(72) Inventor: Colton Todd Conn, Carmel, IN (US)

(73) Assignee: Westfield Outdoor, Inc., Indianapolis, IN (US)

( * ) Notice: Subject to any disclaimer, the term of this patent is extended or adjusted under 35 U.S.C. 154(b) by 11 days.

(21) Appl. No.: 17/897,413

(22) Filed: Aug. 29, 2022

(65) Prior Publication Data

US 2024/0065442 A1 Feb. 29, 2024

(51) Int. Cl.
*A47C 4/28* (2006.01)

(52) U.S. Cl.
CPC ..... *A47C 4/286* (2013.01)

(58) Field of Classification Search
CPC ..... A47C 4/286
See application file for complete search history.

(56) References Cited

U.S. PATENT DOCUMENTS

| | | | |
|---|---|---|---|
| 1,027,692 | A | 5/1912 | Cole |
| 6,629,722 | B1 | 10/2003 | Tang |
| 6,736,450 | B2 | 5/2004 | Miyagi |
| 6,824,210 | B2 | 11/2004 | Zheng |
| 9,033,410 | B2 | 5/2015 | Roani et al. |
| 9,451,829 | B2 | 9/2016 | Chen |
| 10,722,034 | B2 | 7/2020 | Winterhalter et al. |
| 10,874,219 | B2 | 12/2020 | Winterhalter et al. |
| D911,733 | S | 3/2021 | Sullivan et al. |
| 11,109,682 | B2 | 9/2021 | Yang |
| 11,382,427 | B2 | 7/2022 | Yang |
| 11,389,003 | B2 | 7/2022 | Winterhalter et al. |
| 2003/0015892 | A1 | 1/2003 | Wu |

FOREIGN PATENT DOCUMENTS

| | | |
|---|---|---|
| CN | 104856487 B | 5/2018 |
| KR | 20170099158 A | 8/2017 |

*Primary Examiner* — Anthony D Barfield
(74) *Attorney, Agent, or Firm* — Thompson Coburn LLP

(57) ABSTRACT

A folding chair has a first frame assembly, a second frame assembly, a front crossbar assembly, and a rear crossbar assembly. The front crossbar assembly has a front primary crossbar member, a front upper secondary crossbar member, a front lower secondary crossbar member, and a locking interface. The locking interface has an upper receiving portion on one end of the channel and a lower receiving portion on an opposite end of the channel. When the folding chair is in the expanded position and the feet of the frame assemblies are supported on a support surface, the front primary crossbar member has an upward facing portion that is releasably retained in the upper receiving portion of the locking interface and a bottom facing portion that is releasably retained in the lower receiving portion of the locking interface.

14 Claims, 9 Drawing Sheets

FOLDING CHAIR

BACKGROUND AND SUMMARY

This disclosure pertains to a folding chair with a cross member that locks when the chair is unfolded in use.

One aspect of the disclosure is a folding chair comprising a first frame assembly, a second frame assembly, a front crossbar assembly, and a rear crossbar assembly. The first frame assembly comprises a seat member operatively pivotally connected to a backrest member. The first frame assembly comprises a front foot and a rear foot for supporting the folding chair. The second frame assembly comprises a seat member operatively pivotally connected to the backrest member. The second frame assembly comprises a front foot and a rear foot for supporting the folding chair. The front and rear crossbar assemblies are operatively pivotally connected to the first and second frame assemblies to enable movement of the first and second frame assemblies between an expanded position and a collapsed position. In the expanded position, the first frame assembly is spaced from the second frame assembly at a first distance. In the collapsed position, the first frame assembly is spaced from the second frame assembly at a second distance. The second distance is less than the first distance.

In one aspect of the folding chair, the front crossbar assembly comprises a front primary crossbar member, a front upper secondary crossbar member, a front lower secondary crossbar member, and a locking interface. The front primary crossbar member has a length longer than a length of the front upper secondary crossbar member. The front primary crossbar member has a length longer than a length of the front lower secondary crossbar member. The front primary crossbar member has a first end operatively pivotally connected to the second frame assembly adjacent to the seat member of the second frame assembly. The front primary crossbar member has a second end opposite the first end operatively pivotally connected to the first frame assembly adjacent to the front foot of the first frame assembly. The front primary crossbar member passes through a channel of the locking interface. The front primary crossbar member is pivotally connected to the locking interface.

The front upper secondary crossbar member has a first end operatively pivotally connected to the first frame assembly adjacent to the seat member of the first frame assembly. The front upper secondary crossbar member has a second end opposite the first end operatively pivotally connected to the locking interface. The front lower secondary crossbar member has a first end operatively pivotally connected to the locking interface. The front lower secondary crossbar member has a second end opposite of the first end that is operatively pivotally connected to the second frame assembly adjacent to the front foot of the second frame assembly. The front upper secondary crossbar member and front lower secondary crossbar member are operatively pivotally connected to the locking interface such that neither of the front secondary crossbar members intersect with the front primary crossbar member.

The rear crossbar assembly comprises a rear primary crossbar member, a rear upper secondary crossbar member, a rear lower secondary crossbar member, and an interface. The rear primary crossbar member has a length longer than a length of the rear upper secondary crossbar member. The rear primary crossbar member has a length longer than a length of the rear lower secondary crossbar member. The rear primary crossbar member has a first end operatively pivotally connected to one of the first and second frame assemblies on the backrest member of the respective frame assembly. The primary crossbar member has a second end opposite the first end operatively pivotally connected to the other of the first and second frame assemblies adjacent to the rear foot of the respective frame assembly. The rear primary crossbar member passes through a channel of the interface. The rear primary crossbar member is pivotally connected to the interface.

The rear upper secondary crossbar member has a first end operatively pivotally connected to the other of the first and second frame assemblies adjacent the backrest member of the respective frame assembly. The rear upper secondary crossbar member has a second end opposite the first end operatively pivotally connected to the interface. The rear lower secondary crossbar member has a first end operatively pivotally connected to the interface. The rear lower secondary crossbar member has a second end opposite of the first end that is operatively pivotally connected to the second frame assembly adjacent to the front foot of the one of the first and second frame assemblies. The rear upper secondary crossbar member and rear lower secondary crossbar member are operatively pivotally connected to the interface such that neither of the rear secondary crossbar members intersect with the rear primary crossbar member.

The locking interface has an upper receiving portion on one end of the channel and a lower receiving portion on an opposite end of the channel. When the folding chair is in the expanded position and the feet of the frame assemblies are supported on a support surface, the front primary crossbar member has an upward facing portion that is releasably retained in the upper receiving portion of the locking interface and a bottom facing portion that is releasably retained in the lower receiving portion of the locking interface.

Another aspect of the disclosure is a folding chair comprising a first frame assembly, a second frame assembly, a front crossbar assembly, and a rear crossbar assembly. The first frame assembly comprises a seat member operatively pivotally connected to a backrest member. The first frame assembly comprises a front foot and a rear foot for supporting the folding chair. The second frame assembly comprises a seat member operatively pivotally connected to the backrest member. The second frame assembly comprises a front foot and a rear foot for supporting the folding chair. The front and rear crossbar assemblies are operatively pivotally connected to the first and second frame assemblies to enable movement of the first and second frame assemblies between an expanded position and a collapsed position. In the expanded position, the first frame assembly is spaced from the second frame assembly at a first distance. In the collapsed position, the first frame assembly is spaced from the second frame assembly at a second distance. The second distance is less than the first distance.

The front crossbar assembly comprises a front primary crossbar member, a front upper secondary crossbar member, a front lower secondary crossbar member, and an interface. The front primary crossbar member has a length longer than a length of the front upper secondary crossbar member. The front primary crossbar member has a length longer than a length of the front lower secondary crossbar member. The front primary crossbar member has a first end operatively pivotally connected to the second frame assembly adjacent to the seat member of the second frame assembly. The front primary crossbar member has a second end opposite the first end operatively pivotally connected to the first frame assembly adjacent to the front foot of the first frame assembly. The front primary crossbar member passes through a channel of the interface. The front primary crossbar member is pivotally connected to the interface.

The front upper secondary crossbar member has a first end operatively pivotally connected to the first frame assembly adjacent to the seat member of the first frame assembly. The front upper secondary crossbar member has a second end opposite the first end operatively pivotally connected to the interface. The front lower secondary crossbar member has a first end operatively pivotally connected to the interface. The front lower secondary crossbar member has a second end opposite of the first end that is operatively pivotally connected to the second frame assembly adjacent to the front foot of the second frame assembly. The front upper secondary crossbar member and front lower secondary crossbar member are operatively pivotally connected to the interface such that neither of the front secondary crossbar members intersect with the front primary crossbar member.

The rear crossbar assembly comprises a rear primary crossbar member, a rear upper secondary crossbar member, a rear lower secondary crossbar member, and a locking interface. The rear primary crossbar member has a length longer than a length of the rear upper secondary crossbar member. The rear primary crossbar member has a length longer than a length of the rear lower secondary crossbar member. The rear primary crossbar member has a first end operatively pivotally connected to one of the first and second frame assemblies on the backrest member of the respective frame assembly. The rear primary crossbar member has a second end opposite the first end operatively pivotally connected to the other of the first and second frame assemblies adjacent to the rear foot of the respective frame assembly. The rear primary crossbar member passes through a channel of the locking interface. The rear primary crossbar member is pivotally connected to the locking interface.

The rear upper secondary crossbar member has a first end operatively pivotally connected to the other of the first and second frame assemblies adjacent the backrest member of the respective frame assembly. The rear upper secondary crossbar member has a second end opposite the first end operatively pivotally connected to the locking interface. The rear lower secondary crossbar member has a first end operatively pivotally connected to the locking interface. The rear lower secondary crossbar member has a second end opposite of the first end that is operatively pivotally connected to the second frame assembly adjacent to the front foot of the one of the first and second frame assemblies. The rear upper secondary crossbar member and rear lower secondary crossbar member are operatively pivotally connected to the locking interface such that neither of the rear secondary crossbar members intersect with the rear primary crossbar member. The locking interface has an upper receiving portion on one end of the channel and a lower receiving portion on an opposite end of the channel. When the folding chair is in the expanded position and the feet of the frame assemblies are supported on a support surface, the rear primary crossbar member has an upward facing portion that is releasably retained in the upper receiving portion of the locking interface and a bottom facing portion that is releasably retained in the lower receiving portion of the locking interface.

Yet another aspect of the disclosure is a folding chair comprising a first frame assembly, a second frame assembly, a front crossbar assembly, and a rear crossbar assembly. The first frame assembly comprises a seat member operatively pivotally connected to a backrest member. The first frame assembly comprises a front foot and a rear foot for supporting the folding chair. The second frame assembly comprises a seat member operatively pivotally connected to the backrest member. The second frame assembly comprises a front foot and a rear foot for supporting the folding chair. The front and rear crossbar assemblies are operatively pivotally connected to the first and second frame assemblies to enable movement of the first and second frame assemblies between an expanded position and a collapsed position. In the expanded position, the first frame assembly is spaced from the second frame assembly at a first distance. In the collapsed position, the first frame assembly is spaced from the second frame assembly at a second distance. The second distance is less than the first distance.

The front crossbar assembly comprises a front primary crossbar member, a front upper secondary crossbar member, a front lower secondary crossbar member, and a first locking interface. The front primary crossbar member has a length longer than a length of the front upper secondary crossbar member. The front primary crossbar member has a length longer than a length of the front lower secondary crossbar member. The front primary crossbar member has a first end operatively pivotally connected to the second frame assembly adjacent to the seat member of the second frame assembly. The front primary crossbar member has a second end opposite the first end operatively pivotally connected to the first frame assembly adjacent to the front foot of the first frame assembly. The front primary crossbar member passes through a channel of the first locking interface. The front primary crossbar member is pivotally connected to the first locking interface.

The front upper secondary crossbar member has a first end operatively pivotally connected to the first frame assembly adjacent to the seat member of the first frame assembly. The front upper secondary crossbar member has a second end opposite the first end operatively pivotally connected to the first locking interface. The front lower secondary crossbar member has a first end operatively pivotally connected to the first locking interface. The front lower secondary crossbar member has a second end opposite of the first end that is operatively pivotally connected to the second frame assembly adjacent to the front foot of the second frame assembly. The front upper secondary crossbar member and front lower secondary crossbar member are operatively pivotally connected to the first locking interface such that neither of the front secondary crossbar members intersect with the front primary crossbar member.

The rear crossbar assembly comprises a rear primary crossbar member, a rear upper secondary crossbar member, a rear lower secondary crossbar member, and a second locking interface. The rear primary crossbar member has a length longer than a length of the rear upper secondary crossbar member. The rear primary crossbar member has a length longer than a length of the rear lower secondary crossbar member. The rear primary crossbar member has a first end operatively pivotally connected to one of the first and second frame assemblies on the backrest member of the respective frame assembly. The rear primary crossbar member has a second end opposite the first end operatively pivotally connected to the other of the first and second frame assemblies adjacent to the rear foot of the respective frame assembly. The rear primary crossbar member passes through a channel of the second locking interface. The rear primary crossbar member is pivotally connected to the second locking interface. The rear upper secondary crossbar member has a first end operatively pivotally connected to the other of the first and second frame assemblies adjacent the backrest member of the respective frame assembly. The rear upper secondary crossbar member has a second end opposite the first end operatively pivotally connected to the second locking interface. The rear lower secondary crossbar member has a first end operatively pivotally connected to the second locking interface. The rear lower secondary crossbar member has a second end opposite of the first end that is operatively pivotally connected to the second frame assembly adjacent to the front foot of the one of the first and second frame assemblies. The rear upper secondary crossbar member and rear lower secondary crossbar member are operatively pivotally connected to the second locking interface such that neither of the rear secondary crossbar members intersect with the rear primary crossbar member.

The first locking interface has an upper receiving portion on one end of the channel and a lower receiving portion on an opposite end of the channel. When the folding chair is in the expanded position and the feet of the frame assemblies are supported on a support surface, the front primary crossbar member has an upward facing portion that is releasably retained in the upper receiving portion of the first locking interface and a bottom facing portion that is releasably retained in the lower receiving portion of the first locking interface. The second locking interface has an upper receiving portion on one end of the channel and a lower receiving portion on an opposite end of the channel. When the folding chair is in the expanded position and the feet of the frame assemblies are supported on a support surface, the front primary crossbar member has an upward facing portion that is releasably retained in the upper receiving portion of the second locking interface and a bottom facing portion that is releasably retained in the lower receiving portion of the second locking interface.

Further features and advantages, as well as the operation, are described in detail below with reference to the accompanying drawings.

DETAILED DESCRIPTION

Figure 1:
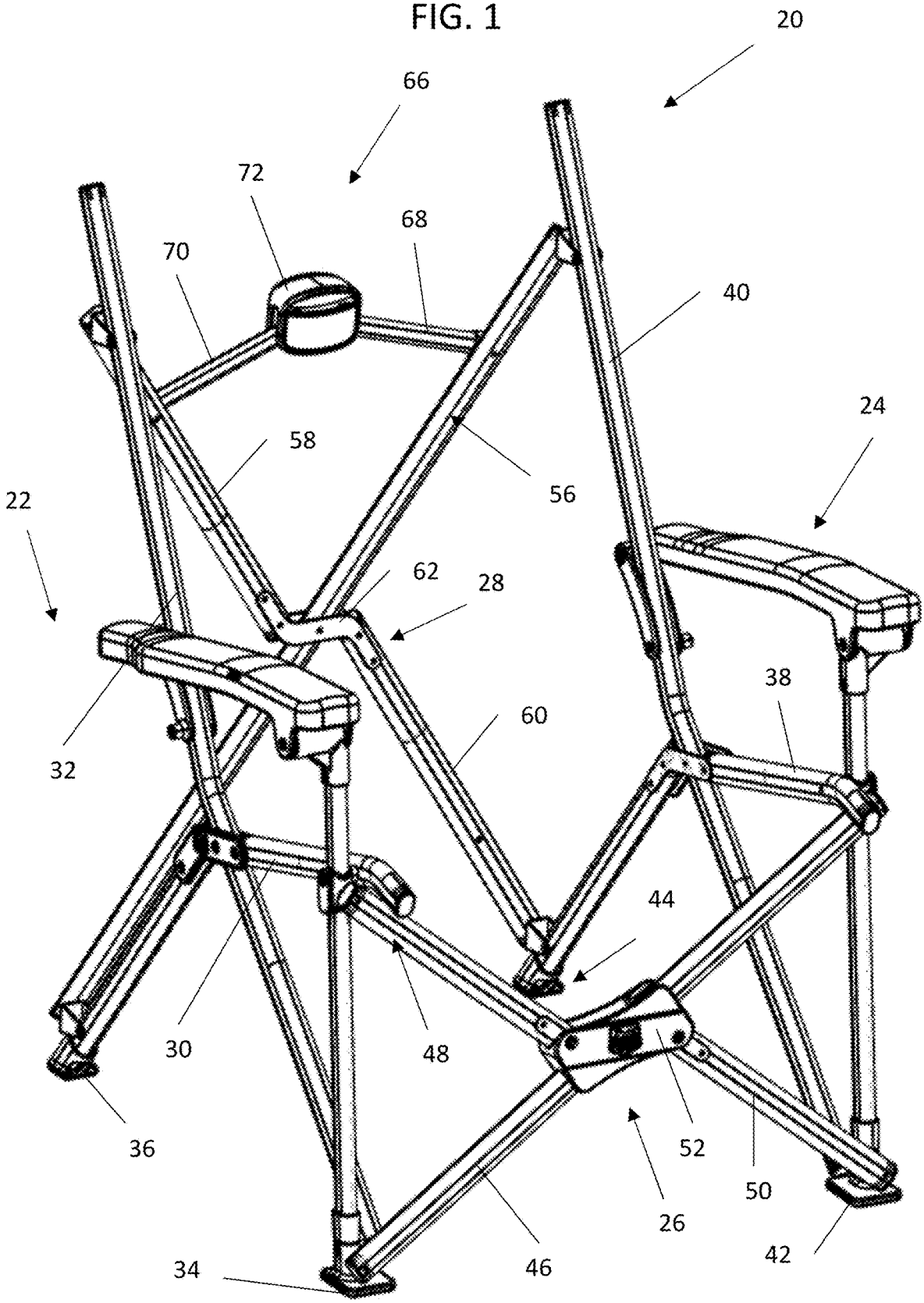
FIG. 1 is a front isometric view of an exemplary folding chair.
Figure 2:
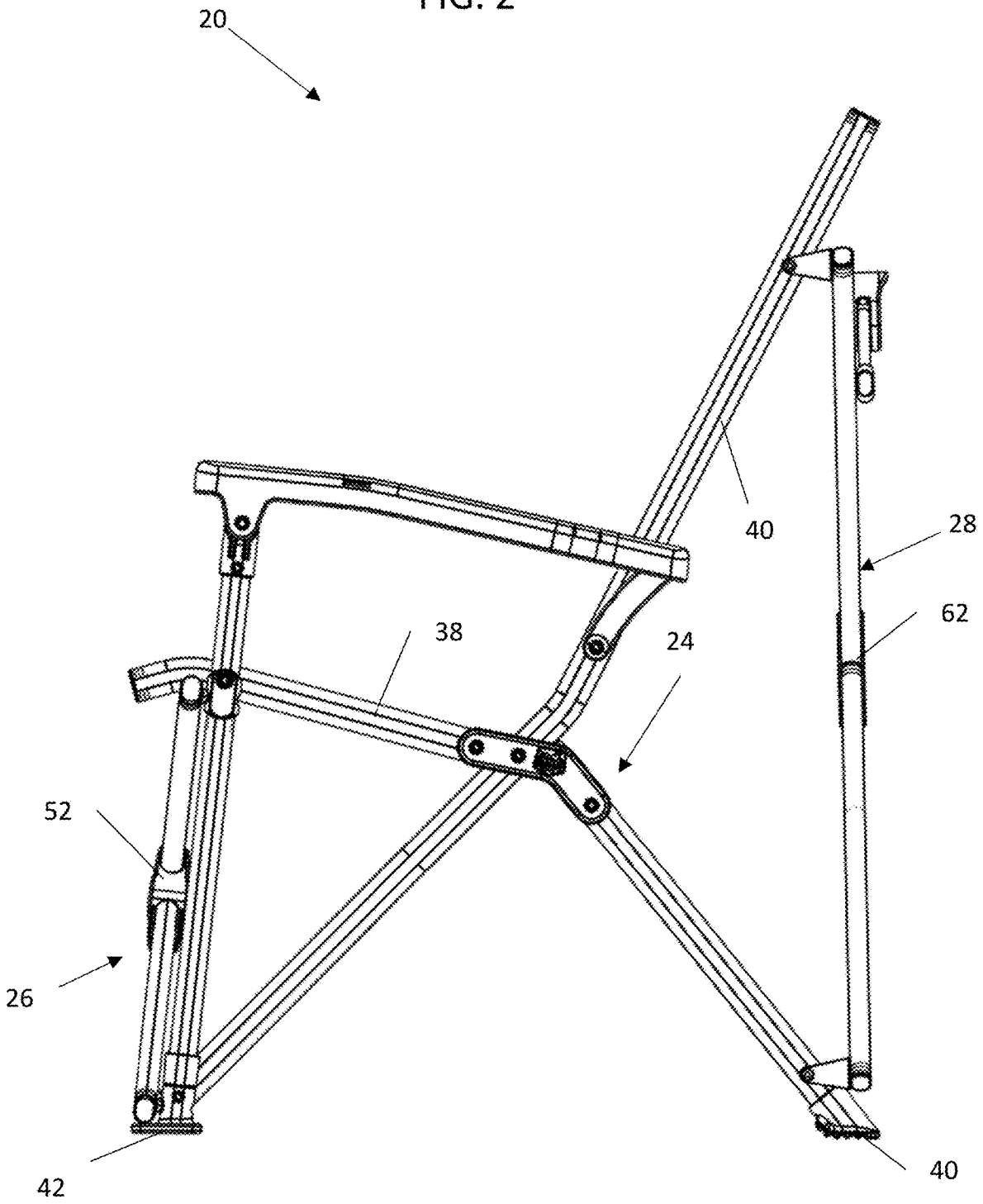
FIG. 2 is a right side view of the folding chair of FIG. 1.
Figure 3:
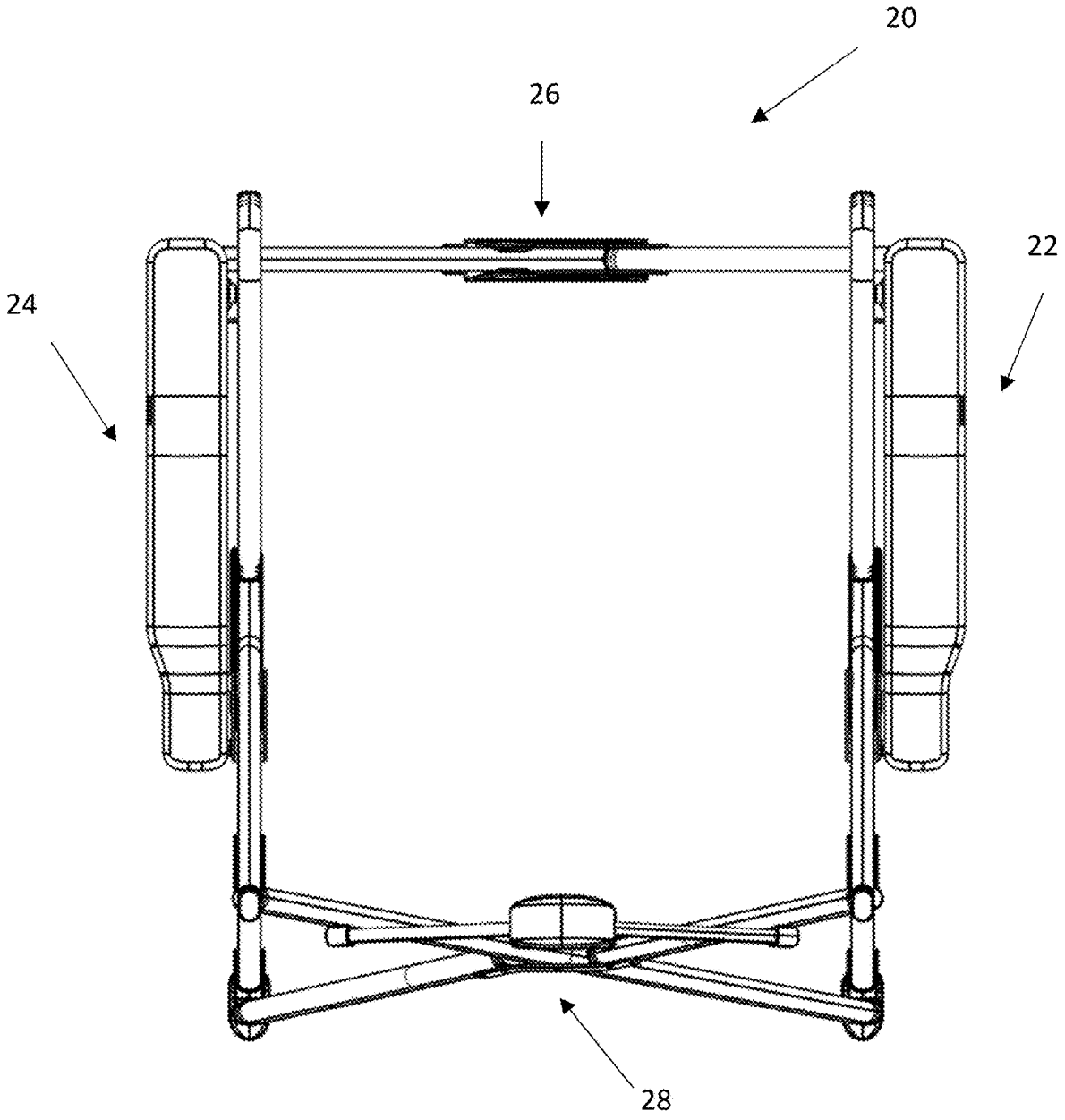
FIG. 3 is a top view of the folding chair of FIG. 1.
Figure 4:
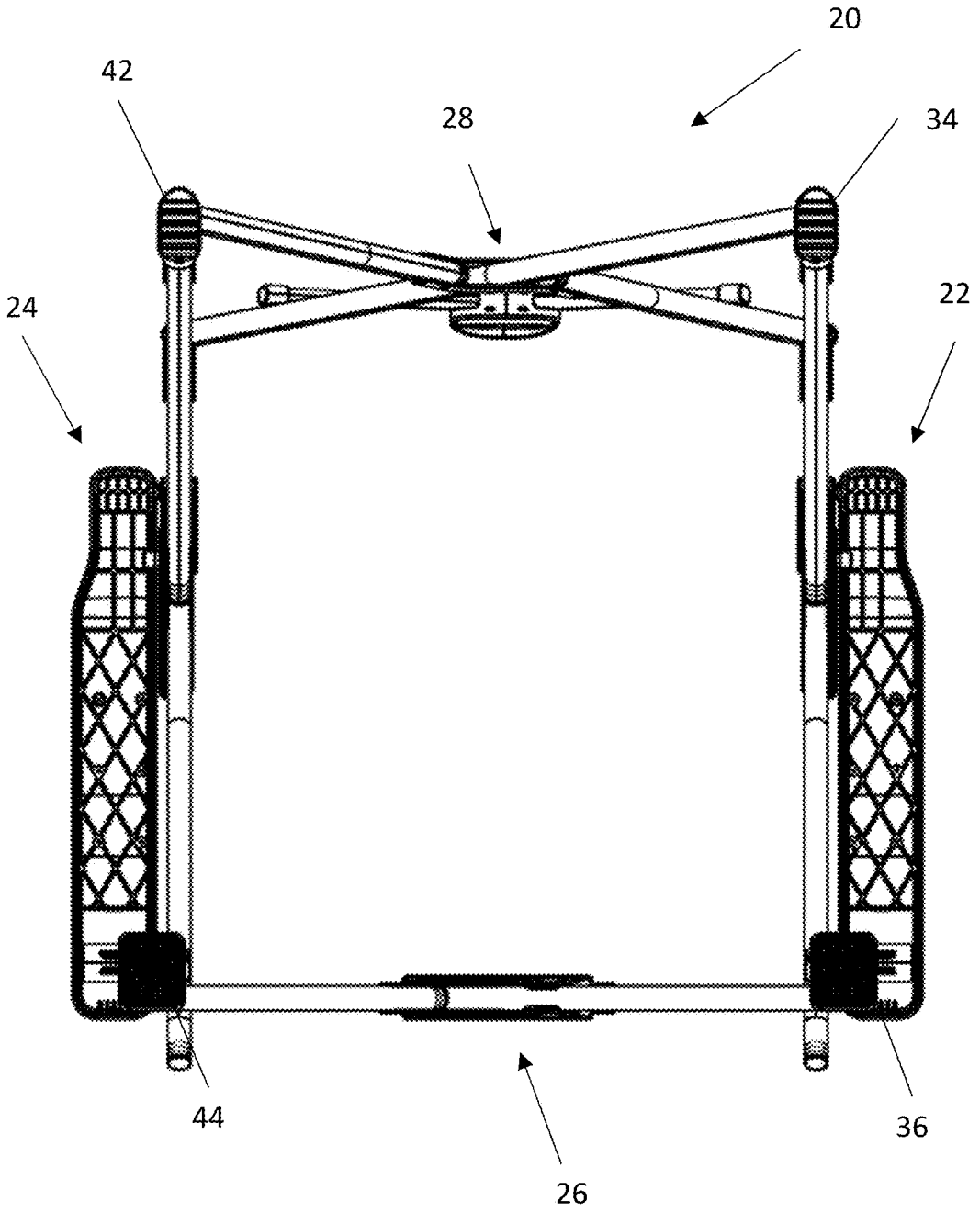
FIG. 4 is a bottom view of the folding chair of FIG. 1.
Figure 5:
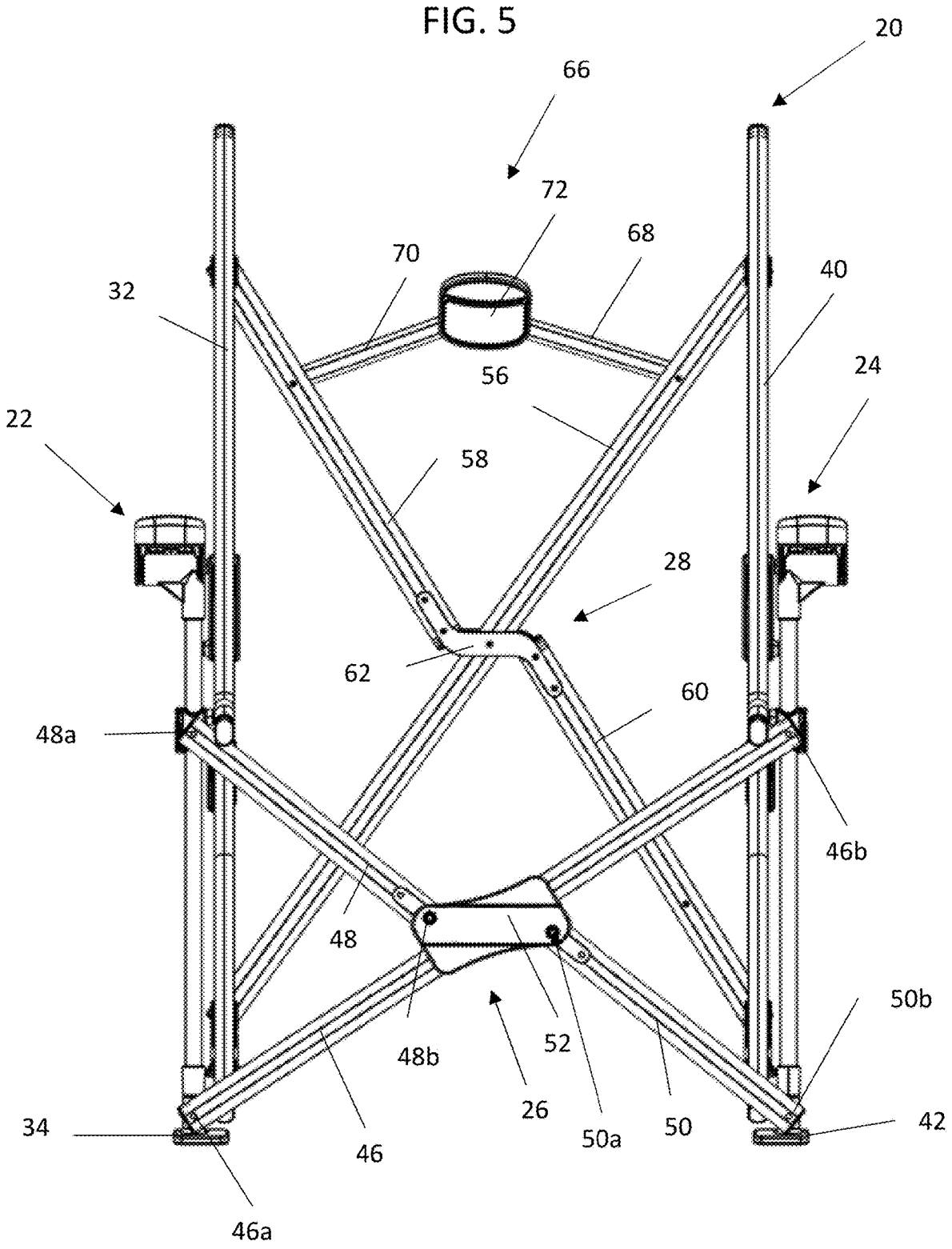
FIG. 5 is a front view of the folding chair of FIG. 1.
Figure 6:
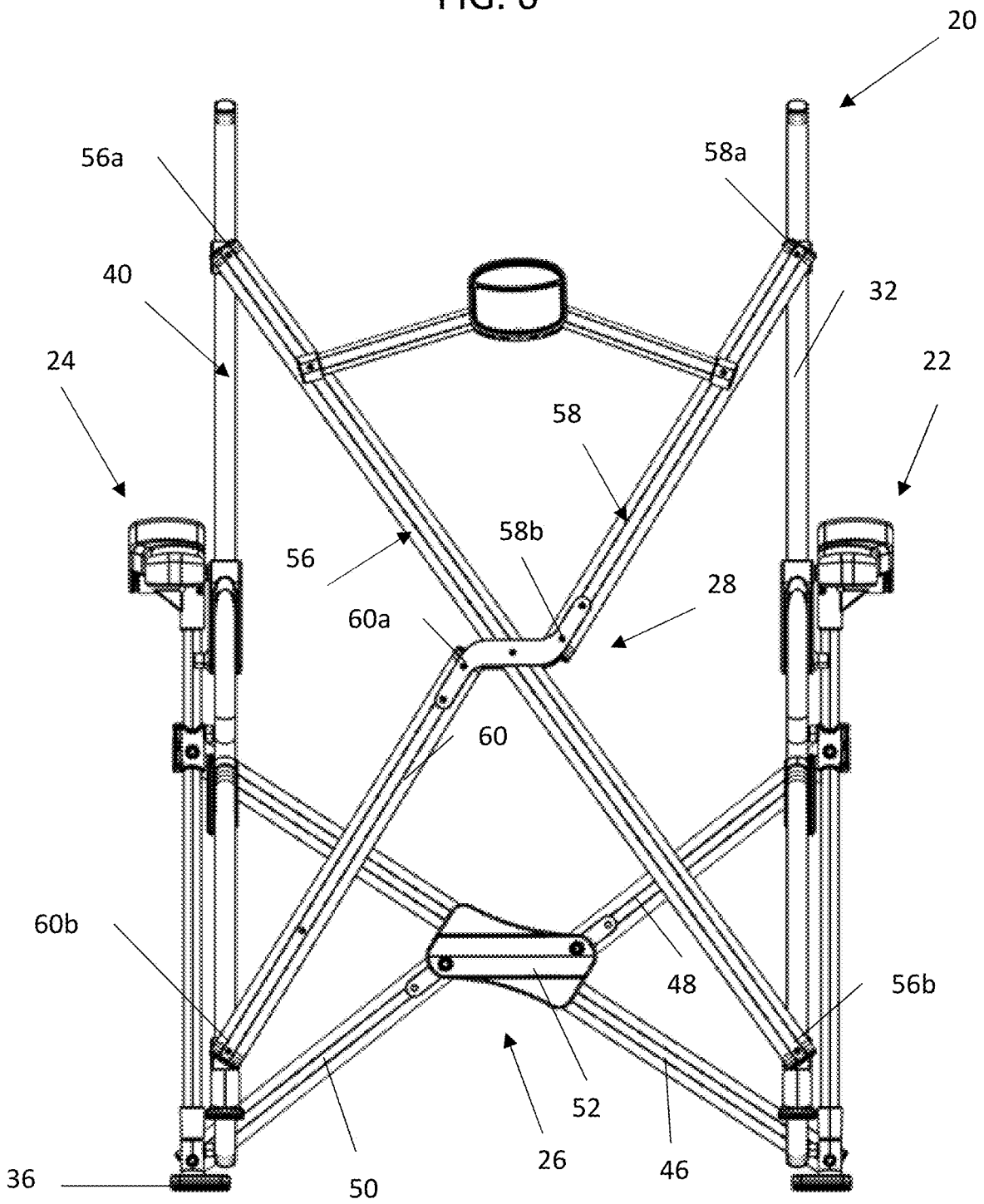
FIG. 6 is a rear view of the folding chair of FIG. 1.

An embodiment of a folding chair, generally indicated by the reference number (20), is shown in FIGS. 1-10. The folding chair (20) may comprise a first frame assembly (22), a second frame assembly (24), a front crossbar assembly (26), and a rear crossbar assembly (28). The first frame assembly (22) may comprise a seat member (30) that may be operatively pivotally connected to a backrest member (32). The first frame assembly (22) also may comprise a front foot (34) and a rear foot (36) for supporting the folding chair. The second frame assembly (24) may comprise a seat member (38) that may be operatively pivotally connected to the backrest member (40). The second frame assembly (24) also may comprise a front foot (42) and a rear foot (44) for supporting the folding chair.

The front and rear crossbar assemblies (26, 28) may be operatively pivotally connected to the first and second frame assemblies (22, 24) to enable movement of the first and second frame assemblies between an expanded position (as shown in FIGS. 1-6) and a collapsed position (not shown). In the expanded position, the first frame assembly (22) may be spaced from the second frame assembly (24) at a first distance. In the collapsed position, the first frame assembly (22) may be spaced from the second frame assembly (24) at a second distance that is less than the first distance.

In the embodiment shown in the Figures, the folding chair may be configured to fold laterally or side to side so the first frame assembly (22) may be generally adjacent to the second frame assembly (24) in the folded position and the front cross bar assembly (26) may be adjacent to the rear cross bar assembly (28) in the folded position. To facilitate this folding arrangement, the first and second frame assemblies may also include a front leg, which may have telescoping members. One telescoping member of the front leg may be operatively connected to the foot (34,42) and the other telescoping member may be operatively connected with the seat member (30,38). The folding chair may also have a rear leg that is operatively pivotally connected with the seat member (30,38) and the backrest member (32,40). The frame assemblies (22, 24) may also include arm rests which connect to the front leg and are operatively pivotally connected to the backrest member or a rear leg, as desired. Other arrangements are possible depending upon the desired folding configuration. For instance, it is not necessary that the front and rear crossbar assemblies be brought adjacent to each other in the collapsed position.

The front crossbar assembly (26) may comprise a front primary crossbar member (46), a front upper secondary crossbar member (48), a front lower secondary crossbar member (50), and a locking interface (52). The front primary crossbar member (46) may have a length longer than a length of the front upper secondary crossbar member (48). The front primary crossbar member (46) also may have a length longer than a length of the front lower secondary crossbar member (50).

The front primary crossbar member 46 may have a first end (46*a*) operatively pivotally connected to the second frame assembly (24) adjacent to the seat member (38) of the second frame assembly (24). The front primary crossbar member (46) may have a second end (46*b*) opposite the first end (46*a*) that may be operatively pivotally connected to the first frame assembly (22) adjacent to the front foot (34) of the first frame assembly (22). The front primary crossbar member (46) may pass through a channel 54 of the locking interface (52). The front primary crossbar member (46) may be pivotally connected to the locking interface (52).

The front upper secondary crossbar member (48) may have a first end (48*a*) operatively pivotally connected to the first frame assembly (22) adjacent to the seat member (30) of the first frame assembly (30). The front upper secondary crossbar member (48) may have a second end (48*b*) opposite the first end (48*a*) that may be operatively pivotally connected to the locking interface (52).

The front lower secondary crossbar member (50) may have a first end (50*a*) that may be operatively pivotally connected to the locking interface (52). The front lower secondary crossbar member (50) may have a second end (50*b*) opposite of the first end (50*a*) that may be operatively pivotally connected to the second frame assembly (24) adjacent to the front foot (42) of the second frame assembly (24).

The front upper secondary crossbar member (48) and front lower secondary crossbar member (50) may be operatively pivotally connected to the locking interface (52) such that neither of the front secondary crossbar members (48, 50) intersect with the front primary crossbar member (46).

The front crossbar assembly may also extend in the opposite direction so the front primary crossbar member first end (46*a*) is operatively pivotally connected to the first frame assembly (22) adjacent to the seat member (30), and the second end (46*b*) is operatively pivotally connected to the second frame assembly (24) adjacent to the front foot (42) of the second frame assembly (22). The relative positions of the front upper and lower secondary crossbar members (48,50) may likewise be reversed so the front upper secondary crossbar member first end (48*a*) is operatively pivotally connected adjacent to the seat member (30) of the second frame assembly (24), and the front lower secondary crossbar member second end (50*b*) is operatively pivotally connected adjacent to the front foot (34) of the first frame assembly (22.

The rear crossbar assembly (28) may comprise a rear crossbar primary member (56), a rear upper secondary crossbar member (58), a rear lower secondary crossbar member (60), and an interface (62). The rear primary crossbar member (56) may have a length longer than a length of the rear upper secondary crossbar member (58). The rear primary crossbar member (56) also may have a length longer than a length of the rear lower secondary crossbar member (60).

The rear primary crossbar member (56) may have a first end (56*a*) operatively pivotally connected to one of the first and second frame assemblies (22, 24) on the backrest member of the respective frame assembly. The rear primary crossbar member (56) may have a second end (56*b*) opposite the first end (56*a*) that is operatively pivotally connected to the other of the first and second frame assemblies (22, 24) adjacent to the rear foot of the respective frame assembly. For instance, as shown in the drawings the primary crossbar member first end (56*a*) is operatively pivotally connected to the backrest member (40) of second frame assembly (24), and the second end (56*b*) is operatively pivotally connected to adjacent to the rear foot (36) of the first frame assembly (22). The rear primary crossbar member (56) may pass through a channel (64) of the interface (62). The rear primary crossbar member (56) may be pivotally connected to the interface (62).

The rear upper secondary crossbar member (58) may have a first end (58*a*) operatively pivotally connected to the other of the first and second frame assemblies (22, 24) adjacent the backrest member of the respective frame assembly. The rear upper secondary crossbar member (58) may have a second end (58*b*) opposite the first end (58*a*) operatively pivotally connected to the interface (62). The rear lower secondary crossbar member (60) may have a first end (60*a*) operatively pivotally connected to the interface (62). The rear lower secondary crossbar member (60) may have a second end (60*b*) opposite of the first end (60*a*) that is operatively pivotally connected to the frame assembly adjacent to the front foot of the one of the first and second frame assemblies (22, 24). By way of example and not in any limiting sense, the drawings show that the rear upper secondary crossbar member first end (56*a*) is operatively pivotally connected to the backrest member (32) of the first frame assembly (22) and the rear lower secondary crossbar member second end (60*b*) is operatively pivotally connected adjacent to the rear foot of the secondary frame assembly (24). The orientation of the rear primary crossbar member (56) and the rear upper and lower secondary crossbar members (58,60) may be reversed.

The rear upper secondary crossbar member (58) and rear lower secondary crossbar member (60) may be operatively pivotally connected to the interface (62) such that neither of the rear secondary crossbar members (58, 60) intersect with the rear primary crossbar member (56).

Figure 7:
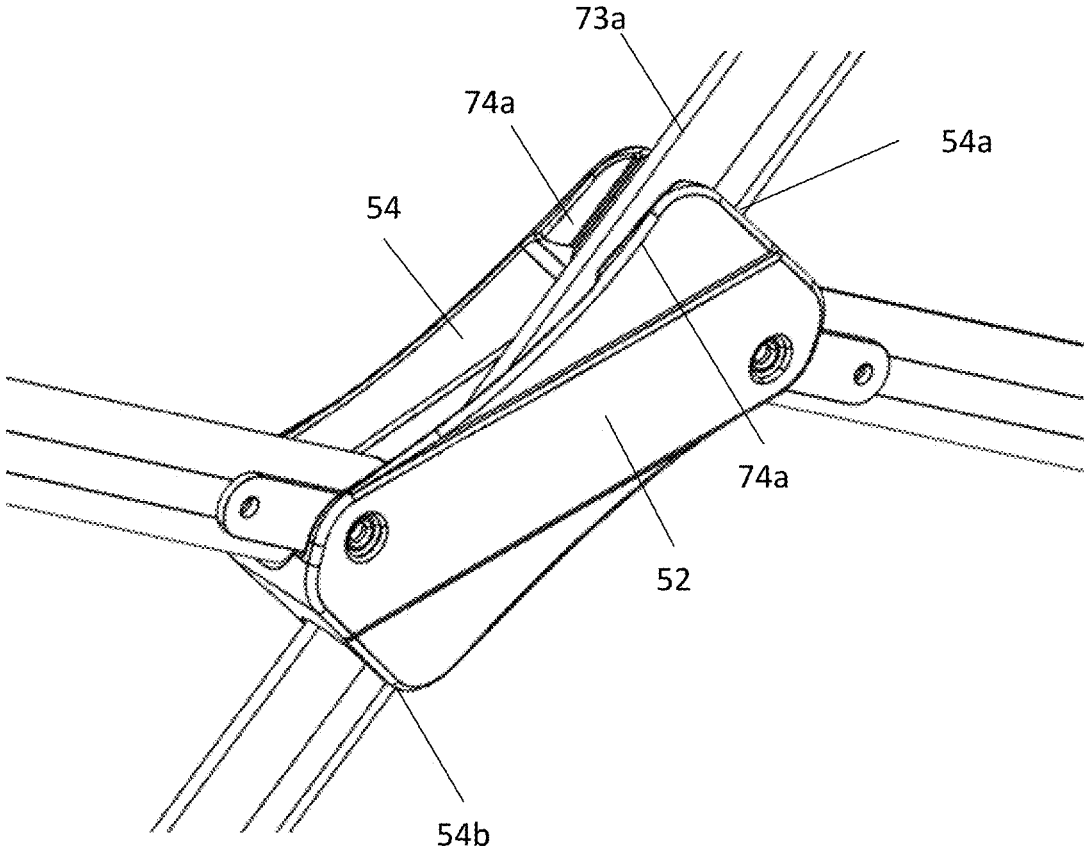
FIG. 7 is a top oriented, partial, enlarged isometric view of a locking interface of the folding chair of FIG. 1.
Figure 8:
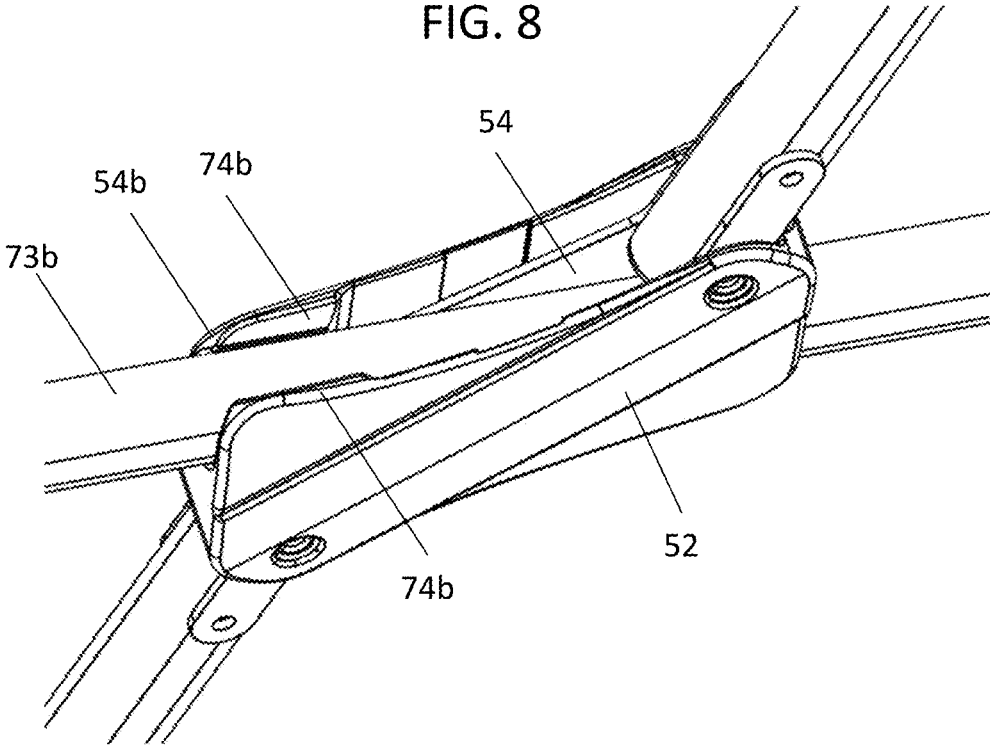
FIG. 8 is a bottom oriented, partial enlarged isometric view of the locking interface of the folding chair of FIG. 1
Figure 9:
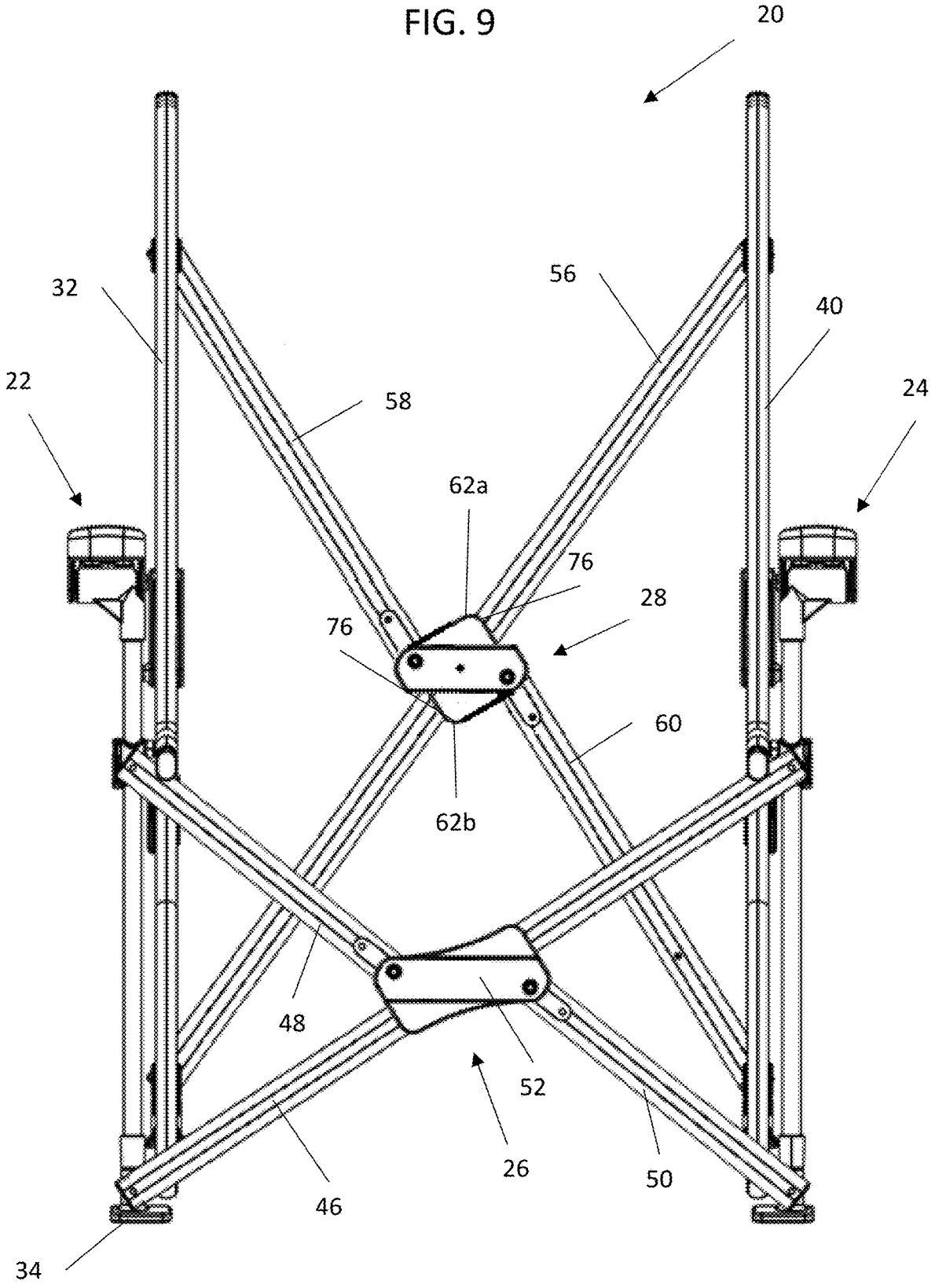
FIG. 9 is a front view of another embodiment of the folding chair with a first locking interface on a front cross bar assembly and a second locking interface on a rear cross bar assembly.
Figure 10:
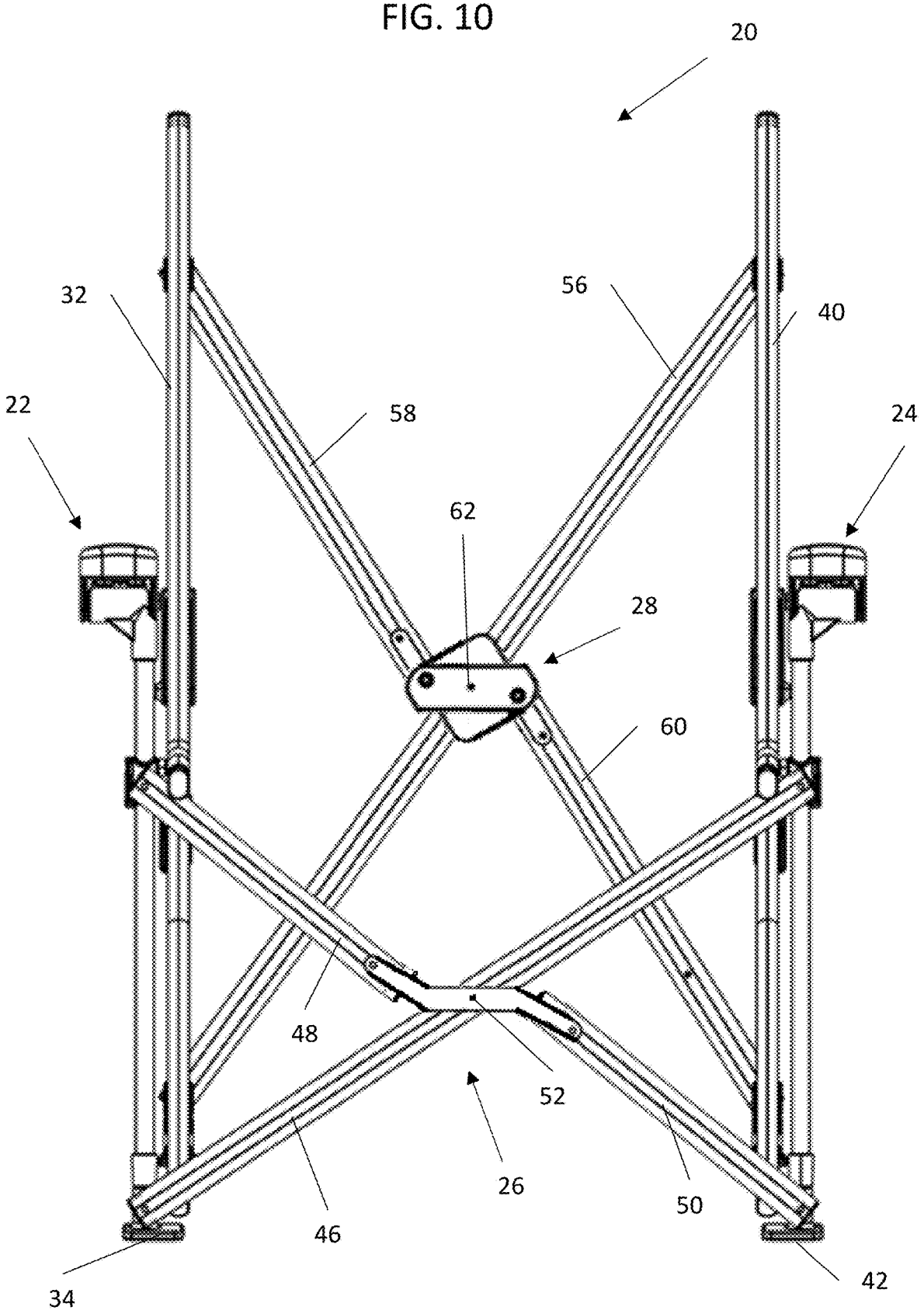
FIG. 10 is a front view of another embodiment of the folding chair with an interface on a front cross bar assembly and a locking interface on a rear cross bar assembly.

As best shown in FIGS. 7-8, the locking interface (52) has an upper receiving portion (54*a*) on one end of the channel (54) and a lower receiving portion (54*b*) on an opposite end of the channel. When the folding chair (20) is in the expanded position and the feet of the frame assemblies are supported on a support surface (not shown), the front primary crossbar member (46) may have an upward facing portion (73*a*) that is releasably retained in the upper receiving portion (54*a*) of the locking interface and a bottom facing portion (73*b*) that is releasably retained in the lower receiving portion (54*b*) of the locking interface (52). Each of the respective receiving portions (54*a*, 54*b*) may comprise a projecting tab (74*a*,74*b*) that is resiliently deflected outward when the primary crossbar member is pressed into the receiving portion of the channel. The projecting tab (74*a*, 74*b*) may have a geometry that complements the geometry of the primary crossbar member so the projecting tab (74*a*,74*b*) engages front and rear side faces of the primary crossbar member as well as the corner and upward facing (73*a*) and bottom facing portions (73*b*) of the primary crossbar member. When the chair is weighted in use (a person is seated in the chair), the primary crossbar member may be seated in the channel of the locking interface. When the chair is moved to the folded configuration the primary crossbar member may be pivoted about its pivot connection with the locking interface (52) and the upward facing portion (73*a*) of the primary crossbar member may deflectingly spread the projecting tabs (74*a*) apart to release the upward facing portion of the primary crossbar member from the upper receiving portion (54*a*). In a similar fashion, when the chair is moved to the folded configuration, the primary crossbar member may be pivoted about its pivot connection with the locking interface (52) and the bottom facing portion (73*b*) of the primary crossbar member may deflectingly spread the projecting tabs (74*b*) apart to release the bottom facing portion of the primary crossbar member from the lower receiving portion (54*b*).

When the folding chair (20) is in the expanded position and the feet of the frame assemblies (22, 24) are supported on a support surface (not shown), the upper receiving portion (54*a*) of the locking interface (62) may be above a point of connection of the front lower secondary crossbar member (50) with the locking interface (52), and the lower receiving portion (54*b*) of the locking interface may be below a point of connection of the front upper secondary crossbar member (48) with the locking interface (52).

A locking interface similar in function and configuration to the locking interface (52) heretofore described may be provided on the rear crossbar assembly (28) instead of the interface (62). In one embodiment, the folding chair may have such a locking interface on the rear crossbar assembly (28) and also on the front crossbar assembly. In another embodiment, the folding chair may have such a locking interface on the rear crossbar assembly (28), and the front crossbar assembly may use an interface similar in function and configuration to the interface (62) heretofore described in connection with the rear crossbar assembly (28). When providing the rear crossbar assembly with the locking interface, the locking interface (62) may have an upper receiving portion (62*a*) on one end of the channel (64) and a lower receiving portion (64*b*) on an opposite end of the channel. When the folding chair (20) is in the expanded position and the feet of the frame assemblies are supported on a support surface (not shown), the rear primary crossbar member (56) may have an upward facing portion that is releasably retained in the upper receiving portion (64*a*) of the locking interface and a bottom facing portion that is releasably retained in the lower receiving portion of the locking interface (64*b*). The receiving portions (64*a*, 64*b*) may have projecting tabs (76) that cooperate with the rear primary crossbar member in the manner as previously described in connection to the front locking interface (52) and front primary crossbar member (46).

As shown in the drawings, the folding chair (20) may further comprise a collapsible handle assembly (66) on the rear crossbar assembly (28), particularly, when the rear crossbar assembly is configured with an interface that does not lock. The collapsible handle assembly may comprise first and second struts (68, 70) and an operator (72). One end of the first strut (68) may be operatively pivotally connected to a top portion of the rear primary crossbar member (56) and an opposite end of the first strut (68) may be operatively connected to the operator (72). One end of the second strut (70) may be operatively pivotally connected to a top portion of the rear upper secondary crossbar member (58) and an opposite end of the second strut (70) may be operatively pivotally connected to the operator (72). The operator (72) may be movable between a collapsed position (not shown) corresponding to the collapsed position of the first and second frame assemblies (22, 24) in which the first and second struts (68, 70) are adjacent to each other along a length of the first and second struts (68, 70) and an expanded position (see FIGS. 1-6 and 8-10) corresponding to the expanded position of the first and second frame assemblies (22, 24) and in which the first and second struts (68, 70) extend outward from the operator (72).

The collapsible handle assembly may also be provided on the front crossbar assembly, particularly, when the front crossbar assembly is provided with an interface that does not lock.

The various crossbar members may have various shapes, including being tubular in shapes. Additionally, the upward facing portion of the front and/or rear primary crossbar members (46, 56) may comprise an upper rounded surface and the bottom facing portion of the front and/or rear primary crossbar members may comprise a lower rounded surface.

In view of the foregoing, it should be appreciated that the invention has several advantages over the prior art.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A folding chair comprising:

a first frame assembly comprising a seat member operatively pivotally connected to a backrest member, the first frame assembly comprising a front foot and a rear foot for supporting the folding chair;

a second frame assembly comprising a seat member operatively pivotally connected to a backrest member, the second frame assembly comprising a front foot and a rear foot for supporting the folding chair;

a front crossbar assembly; and a rear crossbar assembly;

the front and rear crossbar assemblies being operatively pivotally connected to the first and second frame assemblies to enable movement of the first and second frame assemblies between an expanded position and a collapsed position, wherein in the expanded position the first frame assembly is spaced from the second frame assembly at a first distance, and wherein in the collapsed position the first frame assembly is spaced from the second frame assembly at a second distance, the second distance being less than the first distance;

the front crossbar assembly comprising a front primary crossbar member, a front upper secondary crossbar member, a front lower secondary crossbar member, and a locking interface, the front primary crossbar member having a length longer than a length of the front upper secondary crossbar member, the front primary crossbar member having a length longer than a length of the front lower secondary crossbar member, the front primary crossbar member having a first end operatively pivotally connected to the second frame assembly adjacent to the seat member of the second frame assembly, the front primary crossbar member having a second end opposite the first end operatively pivotally connected to the first frame assembly adjacent to the front foot of the first frame assembly, the front primary crossbar member passing through a channel of the locking interface, the front primary crossbar member being pivotally connected to the locking interface, the front upper secondary crossbar member having a first end operatively pivotally connected to the first frame assembly adjacent to the seat member of the first frame assembly, the front upper secondary crossbar member having a second end opposite the first end operatively pivotally connected to the locking interface, the front lower secondary crossbar member having a first end operatively pivotally connected to the locking interface, the front lower secondary crossbar member having a second end opposite of the first end that is operatively pivotally connected to the second frame assembly adjacent to the front foot of the second frame assembly, the front upper secondary crossbar member and front lower secondary crossbar member being operatively pivotally connected to the locking interface such that neither of the front secondary crossbar members intersect with the front primary crossbar member;

the rear crossbar assembly comprising a rear primary crossbar member, a rear upper secondary crossbar member, a rear lower secondary crossbar member, and an interface, the rear primary crossbar member having a length longer than a length of the rear upper secondary crossbar member, the rear primary crossbar member having a length longer than a length of the rear lower secondary crossbar member, the rear primary crossbar member having a first end operatively pivotally connected to one of the first and second frame assemblies on the backrest member of the respective frame assembly, the rear primary crossbar member having a second end opposite the first end operatively pivotally connected to the other of the first and second frame assemblies adjacent to the rear foot of the respective frame assembly, the rear primary crossbar member passing through a channel of the interface, the rear primary crossbar member being pivotally connected to the interface, the rear upper secondary crossbar member having a first end operatively pivotally connected to the other of the first and second frame assemblies adjacent the backrest member of the respective frame assembly, the rear upper secondary crossbar member having a second end opposite the first end operatively pivotally connected to the interface, the rear lower secondary crossbar member having a first end operatively pivotally connected to the interface, the rear lower secondary crossbar member having a second end opposite of the first end that is operatively pivotally connected to the second frame assembly adjacent to the rear foot of the one of the first and second frame assemblies, the rear upper secondary crossbar member and rear lower secondary crossbar member being operatively pivotally connected to the interface such that neither of the rear secondary crossbar members intersect with the rear primary crossbar member;

wherein the locking interface has an upper receiving portion on one end of the channel and a lower receiving portion on an opposite end of the channel; and wherein when the folding chair is in the expanded position and the feet of the frame assemblies are supported on a support surface, the front primary crossbar member has an upward facing portion that is releasably retained in the upper receiving portion of the locking interface and a downward facing portion that is releasably retained in the lower receiving portion of the locking interface;

wherein the upper receiving portion of the locking interface has projecting tabs with a geometry matching the upward facing portion of the front primary crossbar, wherein the lower receiving portion of the locking interface has projecting tabs with a geometry matching the downward facing portion of the front primary crossbar, and wherein the projecting tabs of the upper and lower receiving portions of the locking interface are resiliently deflectable.

2. The folding chair of claim 1 further comprising a collapsible handle assembly, the collapsible handle assembly comprising first and second struts and an operator, one end of the first strut being operatively pivotally connected to a top portion of the rear primary crossbar member and an opposite end of the first strut being operatively pivotally connected to the operator, one end of the second strut being operatively pivotally connected to a top portion of the rear upper secondary crossbar member and an opposite end of the second strut being operatively pivotally connected to the operator, the operator being movable between a collapsed position corresponding to the collapsed position of the first and second frame assemblies in which the first and second struts are adjacent to each other along a length of the first and second struts, and an expanded position corresponding to the expanded position of the first and second frame assemblies and in which the first and second struts extend outward from the operator.

3. The folding chair of claim 1 wherein the first and second frame assemblies are configured such that the front crossbar assembly is moveable toward the rear crossbar assembly when the first and second frame assemblies move to the collapsed position, and the front crossbar assembly is moveable away from the rear crossbar assembly when the first and second frame assemblies move to the expanded position.

4. The folding chair of claim 1 wherein when the folding chair is in the expanded position and the feet of the frame assemblies are supported on a support surface, the upper receiving portion of the locking interface is above a point of connection of the front lower secondary crossbar member with the locking interface, and the lower receiving portion of the locking interface is below a point of connection of the front upper secondary crossbar member with the locking interface.

5. A folding chair comprising:

a first frame assembly comprising a seat member operatively pivotally connected to a backrest member, the first frame assembly comprising a front foot and a rear foot for supporting the folding chair;

a second frame assembly comprising a seat member operatively pivotally connected to a backrest member, the second frame assembly comprising a front foot and a rear foot for supporting the folding chair;

a front crossbar assembly; and a rear crossbar assembly;

the front and rear crossbar assemblies being operatively pivotally connected to the first and second frame assemblies to enable movement of the first and second frame assemblies between an expanded position and a collapsed position, wherein in the expanded position the first frame assembly is spaced from the second frame assembly at a first distance, and wherein in the collapsed position the first frame assembly is spaced from the second frame assembly at a second distance, the second distance being less than the first distance;

the front crossbar assembly comprising a front primary crossbar member, a front upper secondary crossbar member, a front lower secondary crossbar member, and an interface, the front primary crossbar member having a length longer than a length of the front upper secondary crossbar member, the front primary crossbar member having a length longer than a length of the front lower secondary crossbar member, the front primary crossbar member having a first end operatively pivotally connected to the second frame assembly adjacent to the seat member of the second frame assembly, the front primary crossbar member having a second end opposite the first end operatively pivotally connected to the first frame assembly adjacent to the front foot of the first frame assembly, the front primary crossbar member passing through a channel of the interface, the front primary crossbar member being pivotally connected to the interface, the front upper secondary crossbar member having a first end operatively pivotally connected to the first frame assembly adjacent to the seat member of the first frame assembly, the front upper secondary crossbar member having a second end opposite the first end operatively pivotally connected to the interface, the front lower secondary crossbar member having a first end operatively pivotally connected to the interface, the front lower secondary crossbar member having a second end opposite of the first end that is operatively pivotally connected to the second frame assembly adjacent to the front foot of the second frame assembly, the front upper secondary crossbar member and front lower secondary crossbar member being operatively pivotally connected to the interface such that neither of the front secondary crossbar members intersect with the front primary crossbar member;

the rear crossbar assembly comprising a rear primary crossbar member, a rear upper secondary crossbar member, a rear lower secondary crossbar member, and a locking interface, the rear primary crossbar member having a length longer than a length of the rear upper secondary crossbar member, the rear primary crossbar member having a length longer than a length of the rear lower secondary crossbar member, the rear primary crossbar member having a first end operatively pivotally connected to one of the first and second frame assemblies on the backrest member of the respective frame assembly, the rear primary crossbar member having a second end opposite the first end operatively pivotally connected to the other of the first and second frame assemblies adjacent to the rear foot of the respective frame assembly, the rear primary crossbar member passing through a channel of the locking interface, the rear primary crossbar member being pivotally connected to the locking interface, the rear upper secondary crossbar member having a first end operatively pivotally connected to the other of the first and second frame assemblies adjacent the backrest member of the respective frame assembly, the rear upper secondary crossbar member having a second end opposite the first end operatively pivotally connected to the locking interface, the rear lower secondary crossbar member having a first end operatively pivotally connected to the locking interface, the rear lower secondary crossbar member having a second end opposite of the first end that is operatively pivotally connected to the second frame assembly adjacent to the rear foot of the one of the first and second frame assemblies, the rear upper secondary crossbar member and rear lower secondary crossbar member being operatively pivotally connected to the locking interface such that neither of the rear secondary crossbar members intersect with the rear primary crossbar member;

wherein the locking interface has an upper receiving portion on one end of the channel and a lower receiving portion on an opposite end of the channel; and wherein when the folding chair is in the expanded position and the feet of the frame assemblies are supported on a support surface, the rear primary crossbar member has an upward facing portion that is releasably retained in the upper receiving portion of the locking interface and a bottom facing portion that is releasably retained in the lower receiving portion of the locking interface.

6. The folding chair of claim 5 wherein the first and second frame assemblies are configured such that the front crossbar assembly is moveable toward the rear crossbar assembly when the first and second frame assemblies move to the collapsed position, and the front crossbar assembly is moveable away from the rear crossbar assembly when the first and second frame assemblies move to the expanded position.

7. The folding chair of claim 5 wherein the upper receiving portion of the locking interface has projecting tabs with a geometry matching the upward facing portion of the rear primary crossbar.

8. The folding chair of claim 5 wherein the lower receiving portion of the locking interface has projecting tabs with a geometry matching the downward facing portion of the rear primary crossbar.

9. A folding chair comprising:

a first frame assembly comprising a seat member operatively pivotally connected to a backrest member, the first frame assembly comprising a front foot and a rear foot for supporting the folding chair;

a second frame assembly comprising a seat member operatively pivotally connected to a backrest member, the second frame assembly comprising a front foot and a rear foot for supporting the folding chair;

a front crossbar assembly; and a rear crossbar assembly;

the front and rear crossbar assemblies being operatively pivotally connected to the first and second frame assemblies to enable movement of the first and second frame assemblies between an expanded position and a collapsed position, wherein in the expanded position the first frame assembly is spaced from the second frame assembly at a first distance, and wherein in the collapsed position the first frame assembly is spaced from the second frame assembly at a second distance, the second distance being less than the first distance;

the front crossbar assembly comprising a front primary crossbar member, a front upper secondary crossbar member, a front lower secondary crossbar member, and a first locking interface, the front primary crossbar member having a length longer than a length of the front upper secondary crossbar member, the front primary crossbar member having a length longer than a length of the front lower secondary crossbar member, the front primary crossbar member having a first end operatively pivotally connected to the second frame assembly adjacent to the seat member of the second frame assembly, the front primary crossbar member having a second end opposite the first end operatively pivotally connected to the first frame assembly adjacent to the front foot of the first frame assembly, the front primary crossbar member passing through a channel of the first locking interface, the front primary crossbar member being pivotally connected to the first locking interface, the front upper secondary crossbar member having a first end operatively pivotally connected to the first frame assembly adjacent to the seat member of the first frame assembly, the front upper secondary crossbar member having a second end opposite the first end operatively pivotally connected to the first locking interface, the front lower secondary crossbar member having a first end operatively pivotally connected to the first locking interface, the front lower secondary crossbar member having a second end opposite of the first end that is operatively pivotally connected to the second frame assembly adjacent to the front foot of the second frame assembly, the front upper secondary crossbar member and front lower secondary crossbar member being operatively pivotally connected to the first locking interface such that neither of the front secondary crossbar members intersect with the front primary crossbar member;

the rear crossbar assembly comprising a rear primary crossbar member, a rear upper secondary crossbar member, a rear lower secondary crossbar member, and a second locking interface, the rear primary crossbar member having a length longer than a length of the rear upper secondary crossbar member, the rear primary crossbar member having a length longer than a length of the rear lower secondary crossbar member, the rear primary crossbar member having a first end operatively pivotally connected to one of the first and second frame assemblies on the backrest member of the respective frame assembly, the primary crossbar member having a second end opposite the first end operatively pivotally connected to the other of the first and second frame assemblies adjacent to the rear foot of the respective frame assembly, the rear primary crossbar member passing through a channel of the second locking interface, the rear primary crossbar member being pivotally connected to the second locking interface, the rear upper secondary crossbar member having a first end operatively pivotally connected to the other of the first and second frame assemblies adjacent the backrest member of the respective frame assembly, the rear upper secondary crossbar member having a second end opposite the first end operatively pivotally connected to the second locking interface, the rear lower secondary crossbar member having a first end operatively pivotally connected to the second locking interface, the rear lower secondary crossbar member having a second end opposite of the first end that is operatively pivotally connected to the second frame assembly adjacent to the front foot of the one of the first and second frame assemblies, the rear upper secondary crossbar member and rear lower secondary crossbar member being operatively pivotally connected to the second locking interface such that neither of the rear secondary crossbar members intersect with the rear primary crossbar member;

wherein the first locking interface has an upper receiving portion on one end of the channel and a lower receiving portion on an opposite end of the channel;

wherein when the folding chair is in the expanded position and the feet of the frame assemblies are supported on a support surface, the front primary crossbar member has an upward facing portion that is releasably retained in the upper receiving portion of the first locking interface and a bottom facing portion that is releasably retained in the lower receiving portion of the first locking interface;

wherein the second locking interface has an upper receiving portion on one end of the channel and a lower receiving portion on an opposite end of the channel; and wherein when the folding chair is in the expanded position and the feet of the frame assemblies are supported on a support surface, the rear primary crossbar member has an upward facing portion that is releasably retained in the upper receiving portion of the second locking interface and a bottom facing portion that is releasably retained in the lower receiving portion of the second locking interface.

10. The folding chair of claim 9 wherein the first and second frame assemblies are configured such that the front crossbar assembly is moveable toward the rear crossbar assembly when the first and second frame assemblies move to the collapsed position, and the front crossbar assembly is moveable away from the rear crossbar assembly when the first and second frame assemblies move to the expanded position.

11. The folding chair of claim 9 wherein the upper receiving portion of the locking interface has projecting tabs with a geometry matching the upward facing portion of the rear primary crossbar.

12. The folding chair of claim 9 wherein the lower receiving portion of the locking interface has projecting tabs with a geometry matching the downward facing portion of the rear primary crossbar.

13. The folding chair of claim 9 wherein the upper receiving portion of the locking interface has projecting tabs with a geometry matching the upward facing portion of the front primary crossbar.

14. The folding chair of claim 9 wherein the lower receiving portion of the locking interface has projecting tabs with a geometry matching the downward facing portion of the front primary crossbar.

* * * * *